United States Patent [19]

Abel

[11] 3,973,726

[45] Aug. 10, 1976

[54] ELECTROMAGNETIC INDICATOR

[75] Inventor: Donald J. Abel, Franklin Lakes, N.J.

[73] Assignee: Engineered Sinterings and Plastics, Inc., Watertown, Conn.

[22] Filed: Feb. 14, 1975

[21] Appl. No.: 549,941

[52] U.S. Cl. ..... 235/92 A; 235/92 EA; 235/92 R; 335/181; 340/319

[51] Int. Cl.[2] ..... G06M 1/04; G08B 5/00

[58] Field of Search ..... 235/92 A, 92 EA; 335/181; 340/319, 378 MW

[56] References Cited

UNITED STATES PATENTS

| | | | |
|---|---|---|---|
| 1,058,545 | 4/1913 | Caldwell | 235/92 A |
| 3,376,569 | 4/1968 | Watkins | 340/319 |
| 3,588,888 | 6/1971 | Harden | 340/378 MW |
| 3,766,549 | 10/1973 | Kulka et al. | 340/378 MW |

*Primary Examiner*—Joseph M. Thesz
*Attorney, Agent, or Firm*—St. Onge Mayers Steward & Reens

[57] ABSTRACT

In a multi-polar electromagnetically energized rotary indicator each of the pole pieces is associated with a significantly isolated flux path, which, at one end of the turning axis of the rotor part of the indicator, leads diametrically to a flux concentrator displaced 180° from the pole piece in question. In a particular embodiment, this result is realized by a system of separate but mutually nested bridging parts of ferromagnetic material, each of which defines an essentially independent flux path. Other embodiments provide quasi-independent flux paths serving a similar electromagnetic function. An arrangement for sensing the response of an indicator is described.

12 Claims, 15 Drawing Figures

Fig. 6.
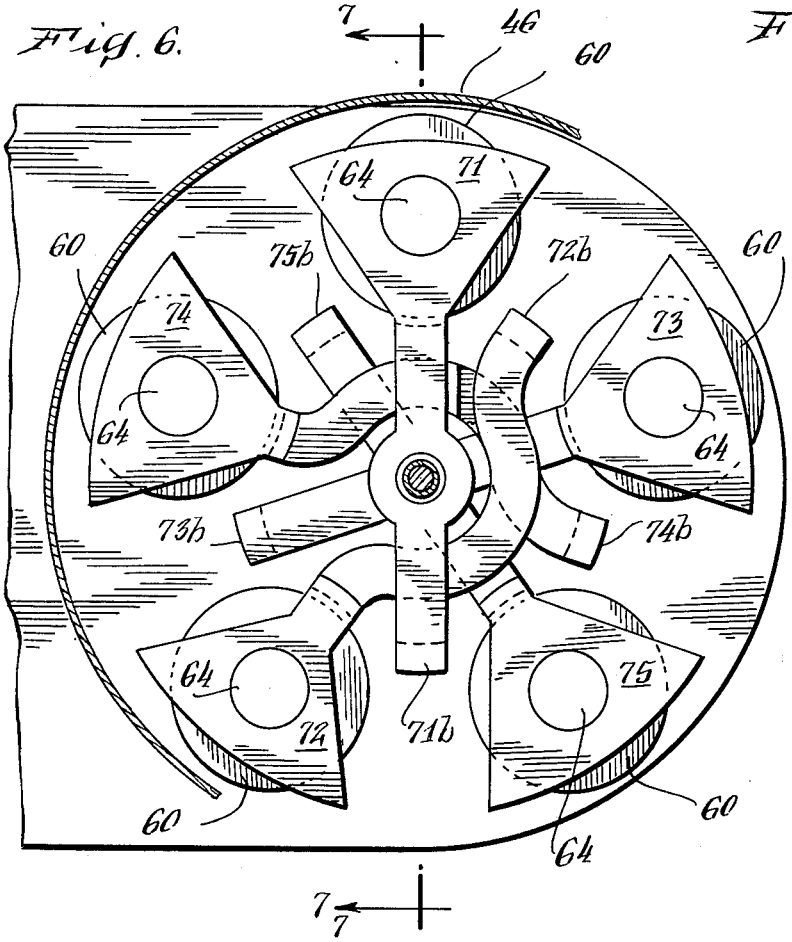
Fig. 7.
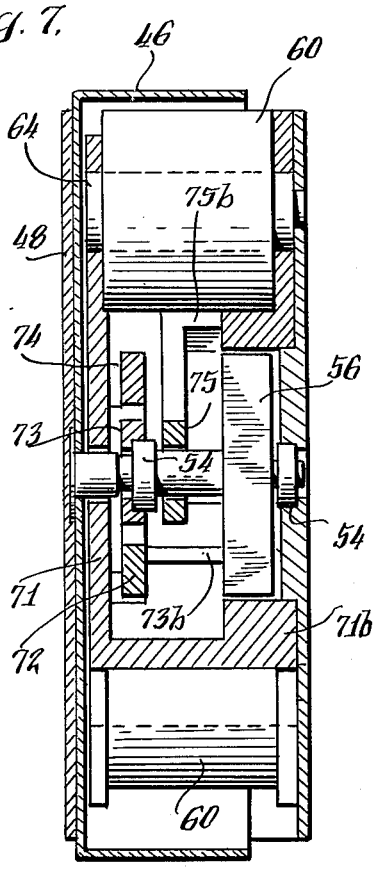
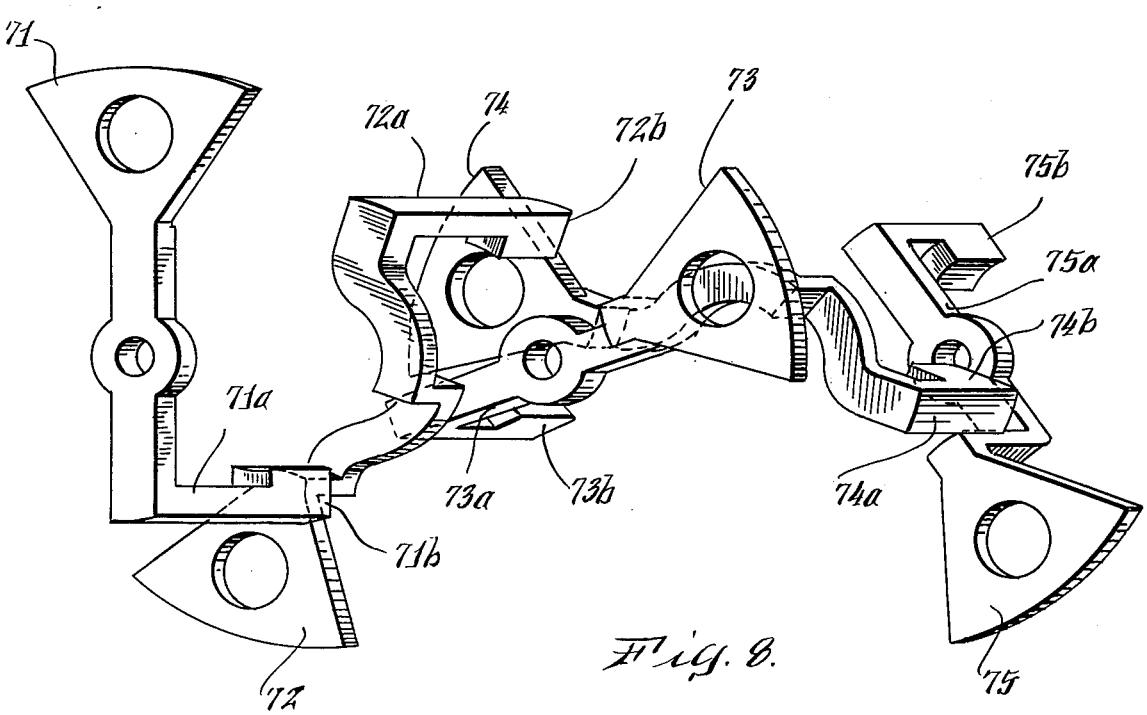
Fig. 8.

168
170
172
S
FF
R
DELAY TRIGGER
FAULT INDICATOR
166'
166
LEVEL SWITCH POLARITY 1
LEVEL SWITCH POLARITY 2
162
INTERROGATING DECODER AND SWITCHES
164
INHIBITOR
30.6
30.7
30.10
41
42
43
44
45
26
150
30.1
30.2
30.3
30.5
COMMAND DECODER AND DRIVER
160
156
SHIFT REGISTER
BCD DATA IN
154
CLOCK
&
158
READ
152
157

ELECTROMAGNETIC INDICATOR

The present invention relates to improved rotary indicators of the type in which a drum or disk bearing numeric or alpha-numeric symbols may be rotated electromagnetically to a selected number of display positions.

Current applications of such indicators require that their energizing mechanisms be extremely compact and of very low power consumption. It is also required that these mechanisms have short transition time from one position to another, high positional accuracy, and low overshoot. The present invention is concerned with the realization of these characteristics within acceptable cost limits.

BRIEF DESCRIPTION OF THE INVENTION

The operating mechanisms of indicators of the class under consideration employ driving means akin to those of conventional electric motors. That is to say, an electrically produced magnetic field is caused to rotate a magnetized armature (e.g. a polarized bar magnet) in order to turn a load-bearing shaft. It is found, however, that direct application of conventional motor design principles leads to constructions which are too large and costly for practical indicator use. The trend has, therefore, been to the combination of a rotor with a stationary circular array of magnetizable poles (typically in multiples of five) with each pole being electromagnetically energized by an associated winding having energizing connections which are independent of those of the remaining windings. While wide variations in construction have been provided, unavoidable dimensional limitations have so far blocked full achievement of industry-desired operating characteristics. For reasons which will be further stated below, it appears that this failure is based in significant part upon deficiencies of the return paths provided for the flux generated by the various electromagnetically excited poles. On this premise, the present invention provides complete or near-complete flux path control for each of the several pole pieces included in the energizing assembly. The result is greater available force to move the rotor, lower wattage for driving, and avoidance of entrapment of the rotor by tangential force fields created upon reversal of polarity of a pole with which the rotor is momentarily aligned.

In a particular and preferred embodiment of the invention these benefits are achieved by providing in association with each of the pole pieces of the electromagnetic system means defining a significantly isolated flux path which, at one end of the turning axis of the rotor part of the mechanism, leads diametrically to a flux concentrator displaced 180° from the pole piece in question. Again in reference to a particularly favored construction, a result of the type just specified is realized by a system of separate but mutually nested bridging parts of ferromagnetic material, each of which parts defines an independent flux path of the kind called for.

It is further found advantageous in particular embodiments of the invention to combine an assembly of the kind just called for with energizing coils for the various pole pieces which are disposed with their axes parallel to the axis of rotation of the magnetized armature. A further advantage of an indicator assembly using an independent flux path in the manner of the invention is obtained when the indicator is used in a circuit with which the arrival of the rotor at the proper position can be checked.

BRIEF DESCRIPTION OF DRAWINGS

For a more detailed understanding of the invention reference may be had to the following description, taken in connection with the accompanying drawings in which:

FIGS. 6, 7 and 8 are Figures which correspond generally to FIGS. 2, 3 and 5, but which illustrate a five-coil rather than a ten-coil energizing assembly;

DETAILED DESCRIPTION OF THE INVENTION

Figure 1:
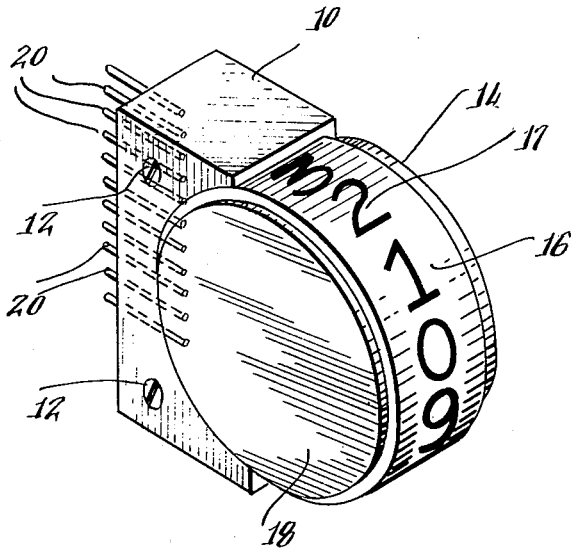
FIG. 1 is a perspective view of an indicator assembly of the type in which the invention is to be employed.

Referring particularly to FIG. 1, there is shown the external aspects of a single digit indicator adapted to be used in a side-by-side array of a number of such indicators. It comprises in the first instance a mounting block 10 having a pair of transverse holes 12 which permit its alignment and assembly with other, similar elements. The block fixedly supports a wall member or backing plate 14 which may, if desired, be formed integrally with the block. From this plate there is supported, by means to be subsequently described, a rotatable indicator drum 16 of light weight non-magnetic material (e.g. aluminum) bearing on its peripheral surface numerals zero through nine as indicated, for example, at 17. A non-magnetic cover plate 18 closes the end of the drum for protection of the operating parts enclosed within it. It may be assumed that in practical use, the indicator as so far described would be used in connection with a viewing window (not shown) through which only one of the numerals 17 could be seen at a given time.

Figure 2:
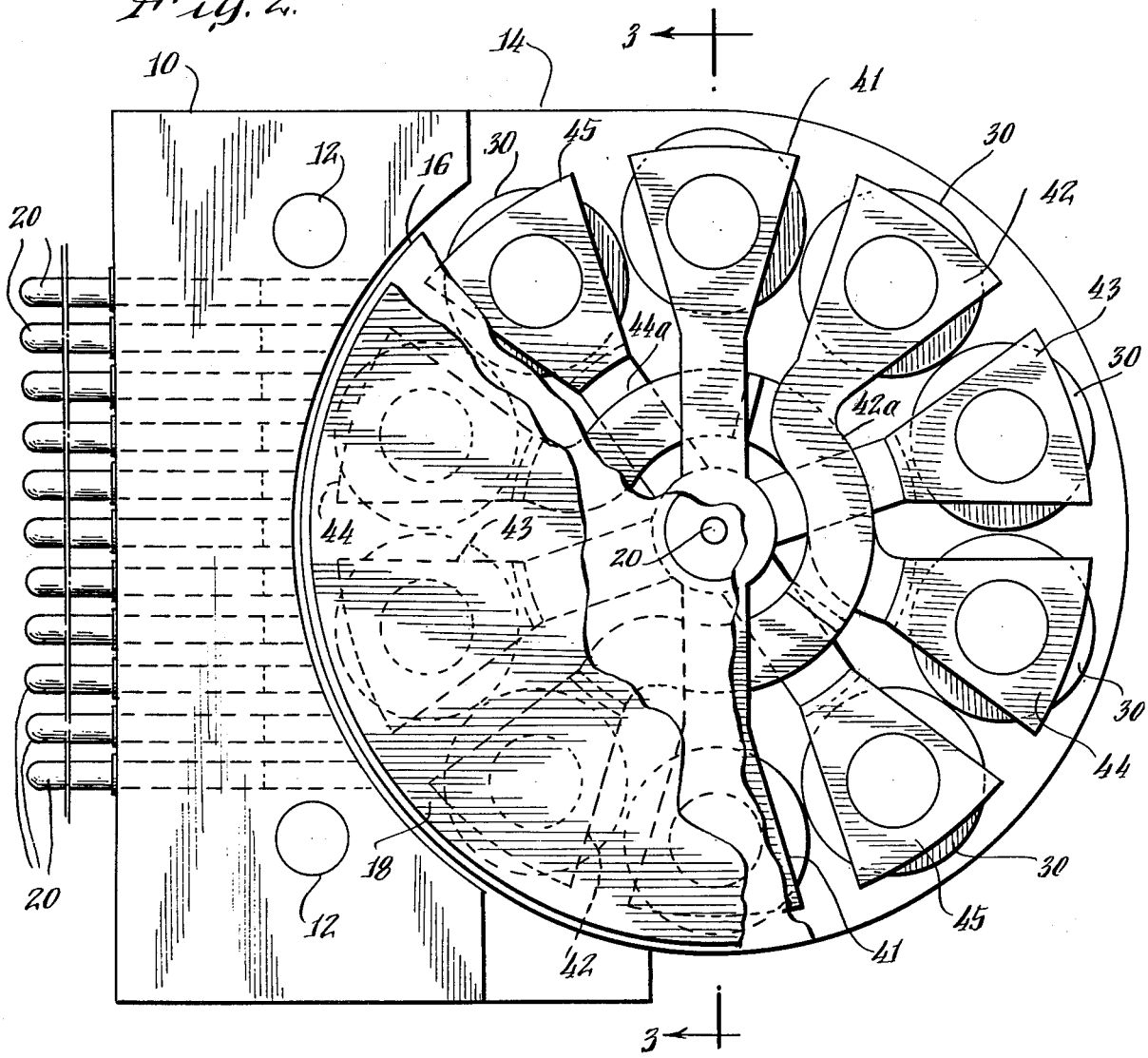
FIG. 2 is a side view, partially broken away, of an indicator having a driving mechanism which incorporates a preferred 10 pole embodiment of the invention.

As appears more adequately in FIG. 2 the base block 10, which may suitably be constituted of insulating plastic, also carries a set of eleven electrically conducting terminals 20. As will be further explained below, it may be assumed that ten of these are respectively connected through appropriate wiring to the primary input terminals of electrical windings (ten in number) provided in circular array within the drum 16. The secondary terminals of these windings may be assumed to be grounded to a single conductor (not shown) which is then brought out to the eleventh one of the terminals 20. It will be understood that by these means the various windings can be separately and independently energized from suitable supply circuits connected to terminals 20.

Figure 3A:
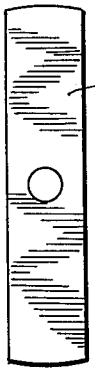
FIGS. 3A and 3B are left-side views of certain parts which are shown in section in FIG. 3.
Figure 3:
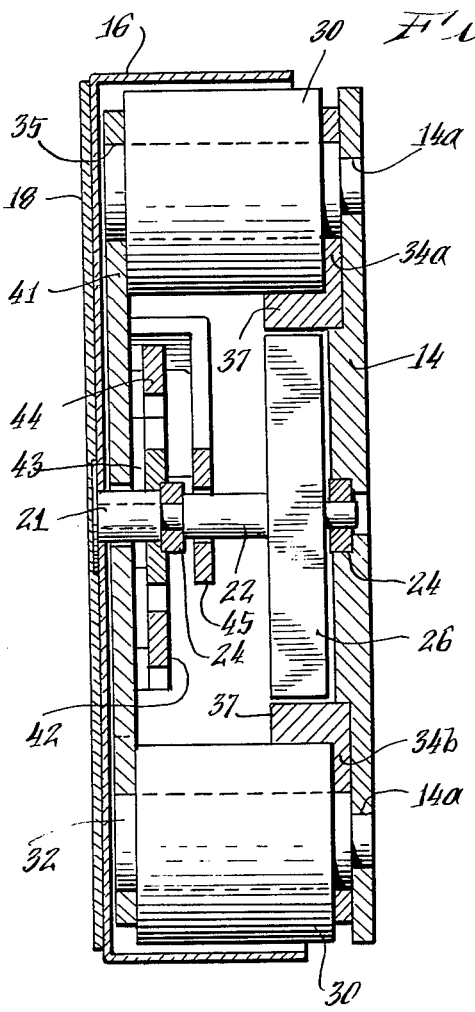
FIG. 3 is an irregular sectional view taken on line 3—3 of FIG. 2.

Referring not to FIG. 3, it will be seen that the drum 16 and cover plate 18 are supported on a cylindrical bushing 21 to which they may be taken as affixed. This bushing is, in turn, secured to the end of a rotatable shaft 22 which turns in low friction (or, if desired, anti-friction) bearings 24, these being themselves supported in the stationary structure of the assembly as illustrated. The rotational position of the shaft 22 is controlled by the position of a permanently magnetized armature 26, which may suitably be a bar magnet as shown in FIG. 3A.

Figure 3B:
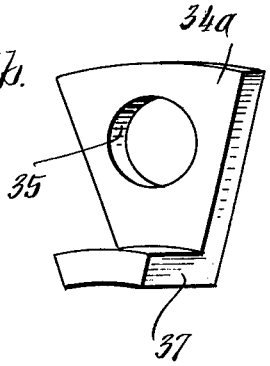

Arranged circumferentially in respect to the axis of the magnet-bearing shaft 22 are a set of ten wire-wound electrically conductive coils 30 (see FIG. 2). For compactness of construction, these are mounted with their axes parallel to the axis of the shaft, being supported in this arrangement by ferromagnetic cylindrical core members 32. As shown in FIG. 3, each core member extends fractionally beyond both ends of its associated coil. At the right hand end each core member extends into and through a conforming opening 35 formed in a ferromagnetic pole piece 34 and is finally supported by engagement in a suitably dimensioned opening 14*a* formed in the backing plate 14. Two of these pole pieces (labelled 34*a* and 34*b* for distinctive reference) are shown in section in FIG. 3, and one of these, 34*a*, is shown face-on in FIG. 3B. Each pole piece terminates in its region of nearest proximity to the rotating magnet 26 in an axially extending tip portion 37 which serves functionally as a flux concentrator with respect to one of the flux-receiving surfaces of the magnet whenever such a surface lies adjacent to the pole piece in question, such a condition being represented in FIG. 3 in reference to the pole pieces 34*a* and 34*b*.

Figure 4:
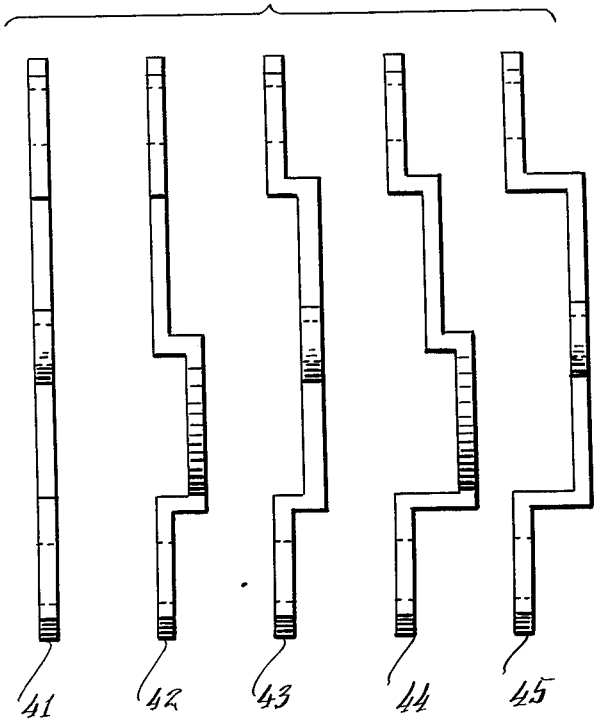
FIG. 4 is a collective view of certain of the parts which are assembled in FIG. 3.
Figure 5:
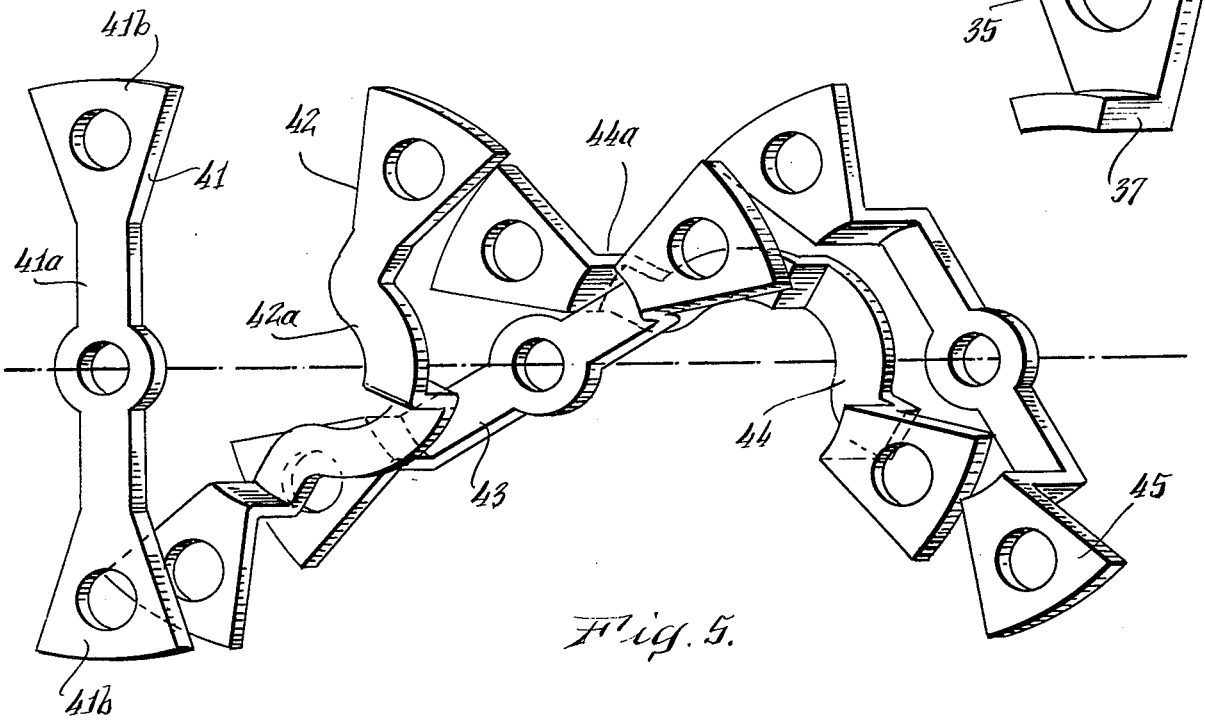
FIG. 5 is an exploded perspective view which illustrates the angular relationships of the parts pictured in FIG. 4 when these parts are arranged as they are in FIGS. 2 and 3.

At the end of each core member which is opposite to the region of its engagement with a pole piece 34, the member has a similar engagement with a member of the set of flux-carrying structures 41 to 45 which is shown in edge view in FIG. 4 and in perspective view in FIG. 5. Each of these members is of ferromagnetic material and is designed to provide (in conjunction with its associated core members 32) a substantially continuous, at least partially isolated, flux path extending first axially, then diametrally across the axis of the rotating system, from a first, flux-supplying pole piece (e.g. the pole piece 34*a*) to a second diametrically opposed flux concentrator (e.g. the pole piece 34*b*).

As used herein, the term "diametrally" is to be taken as meaning in a generally diametric direction, although not necessarily passing directly through the axis of rotation. While this mode of description assumes that only one of the coils 30 will be energized at any given time and that its associated pole piece will thus be a unique source of magnetic flux, it is not intended to preclude operation in which two opposed coils are concurrently energized in mutually reinforcing directions. In such a case each of the two associated pole pieces would serve concurrently as a flux-supplier and as a flux-concentrator within the meaning of these terms as used above. If, in the foregoing description the first pole piece is to be regarded as energized (i.e. by electrical energization of its associated coil 30), then that pole may be viewed at the source of the magnetic flux which is to be covered through the described flux path to the second pole serving in this context as a "flux concentrator" for cooperation with one of the flux-receiving surfaces of the rotating magnet 26.

Because structural compactness is of vital interest in an indicator of the kind under consideration, the present invention concerns itself with means by which magnetic relationships such as those just specified can be provided for each pair of opposed pole pieces without exceeding permissible dimensional limits. This is accomplished in the embodiment of FIGS. 1–5 by giving each of the five flux-carrying structures 41 through 45 a unique configuration which makes it "nestable" with the remaining structures.

As will appear from joint consideration of FIGS. 3, 4 and 5, the configurations chosen for the diametrally extending parts of these structures causes each of them to assume the aspect of a band or strip, having its major dimensions (i.e. those of length and thickness) disposed in planes perpendicular to the axis or rotation of the magnet 26. Moreover, the chosen configurations permit the extremities of each structure to lie in a common plane (corresponding to the general plane of the particular structure 41) while intermediate portions of all structures but 41 are made non-coplanar by being progressively offset diametrally and/or axially in a way which, in the final assembly of the several structures, causes their flux-carrying elements to lie within the space which falls (i) diametrally between the shaft 22 and the ring of coils 30 and (ii) axially between the member 41 and the magnet 26. By this arrangement a very compact assembly is realized, while, at the same time, the magnetic flux paths provided by the several structures 41–45 are mutually isolated to a high degree. A particular mode of applying these principles will not be described.

In reference to the individual flux-carrying structures of FIGS. 1 through 5 it may be said that a. structure 41 is planar, with neither axial nor diametral offset;

b. structure 42 has a half region of two and one half units of axial offset and a full region of diametral offset;

c. structure 43 has a single region of two units of axial offset, but no diametral offset;

d. structure 44 has a half region of two and one quarter units axial offset, a half region of four and one half units axial offset, and a full region of diametral offset; and e. structure 46 has a full region of four and one half units axial offset and no diametral offset.

In the above tabulation, "unit axial offset" refers to an amount of axial offset corresponding approximately to the material thickness of a single flux-carrying structure as pictured in FIG. 4. In a particular construction which has been found practical, this thickness is 0.020 inches. "Full region offset" refers to offset extending over a distance corresponding at least roughly to the length of the bridging part 41*a* illustrated in FIG. 5. "Half region" denotes approximately half this length. "Diametral offset" refers to an arcuate deflection of the structural part around the axis of the rotational shaft 22 as illustrated most clearly by the arcuate regions 42*a* and 44*a* of structures 42 and 44 as these are shown in FIGS. 2 and 5.

With parts relationships such as those just specified, the fan-shaped core-supporting parts of the structures 41–45 will be seen lying in a common plane with a significant spacing between any two adjacent such parts. Moreover, the bridging parts of the various structures (i.e. those parts which connect diametrically opposed core-supporting parts) avoid contact with one another by virtue of the dimensional ratios and topological relationships which have been prescribed. Accordingly, each of the five flux-carrying structures is in effect magnetically independent of all the remaining structures so that fringe leakage between the various structures is kept at a trivial level. A practical and very desirable result of this circumstance is that upon reversal of applied magnetization by shifting energization from one of the coils 30 to its diametrically opposite number (as when the indicator is called upon to rotate 180°), there is no tendency for lock-in to occur because of the existence of equally balanced fringe fields. Liability to fringe-field lock-in has been a problem of concern in previous indicator designs, and attempts to eliminate it by providing shielding means or asymmetrical flux shunting means have led to complexity of structure and/or increased manufacturing costs which are avoided in connection with the present invention.

As a preferred application of the present invention, compactness of structure is further served by arranging all of the coils 30 with their axes generally parallel to the axis of rotation of the magnet 26. This in turn is achieved by disposing all of the core members 32 parallel to the shaft 22, as illustrated. While axial coil disposition is not new in the general sense, it is believed to be new in a context such as the present one in which the associated magnetic structure provides complete flux path control from each pole piece to the diametrically opposed extremity of the magnetized rotor.

While the invention has so far been described in connection with an indicator system having ten separately energizable coils (corresponding to the number of digits ordinarily required to be displayed) it will be apparent that other even-number coil sets may alternatively be employed. It is also possible, as is known, to halve the number of coils and to rely on reversal of the direction of coil energization to move the rotor from a first locked-in position to a new position 180° displaced from the first position. This principle can be applied while still realizing the principal advantages of the present invention by the five-coil construction shown in FIGS. 6, 7 and 8.

As will be seen, this construction also applies the concept of nested but separate paths to carry magnetic flux from a coil-energized magnetic pole to a diametrically disposed flux concentrator cooperative with an opposite flux-receiving surface of the rotor magnet. Referring to FIGS. 6 and 7, parts which in these figures have functions similar to parts already fully described in FIGS. 1 through 5 simply bear numerals thrity units advanced from the numerals applied to the similar parts in FIGS. 1 through 5. Thus, in FIG. 6, five coils 60 are shown, each supported on a core member 62, and each closely associated with a pole piece 64 (FIG. 7), similar in construction to the pole pieces 34 of FIGS. 3 and 3B. At its extremity opposite to the region of its connection with a pole piece, each core member is fitted into the fan-shaped portion of a flux-carrying structure (items 71 to 75) which up to its midpoint resembles the corresponding one of the structural set 41–45 of FIGS. 4 and 5. However, rather than terminating symmetrically in a second core-piece receiving part, as in FIGS. 4 and 5, each of the structures 71 to 75 bears at its coil-opposed extremity a flux-carrying extension (71*a* etc.) which proceeds parallel to the shaft 52. Each such extension terminates at a point lying in the plane of rotation of the magnet 56, at which point it carries a flux concentrator (71*b* etc.) that, in an appropriate position of the magnet will be adjacent to a flux-receiving surface of the magnet. With these provisions, operation of the indicator of FIGS. 6 through 8 will be somewhat different from that of the indicator of FIGS. 1 through 5 in that, in order to achieve ten location positions of the indicator, two-way (i.e. reversible) energization of each coil will be required in the new construction as contrasted with one-way energization for the other. Nevertheless, the basic principle of fully controlled flux return (i.e. from one end of the magnetic rotor to the other) is preserved, as is the desired freedom from lock-in upon attempted 180° reversal of the magnet.

Figure 9:
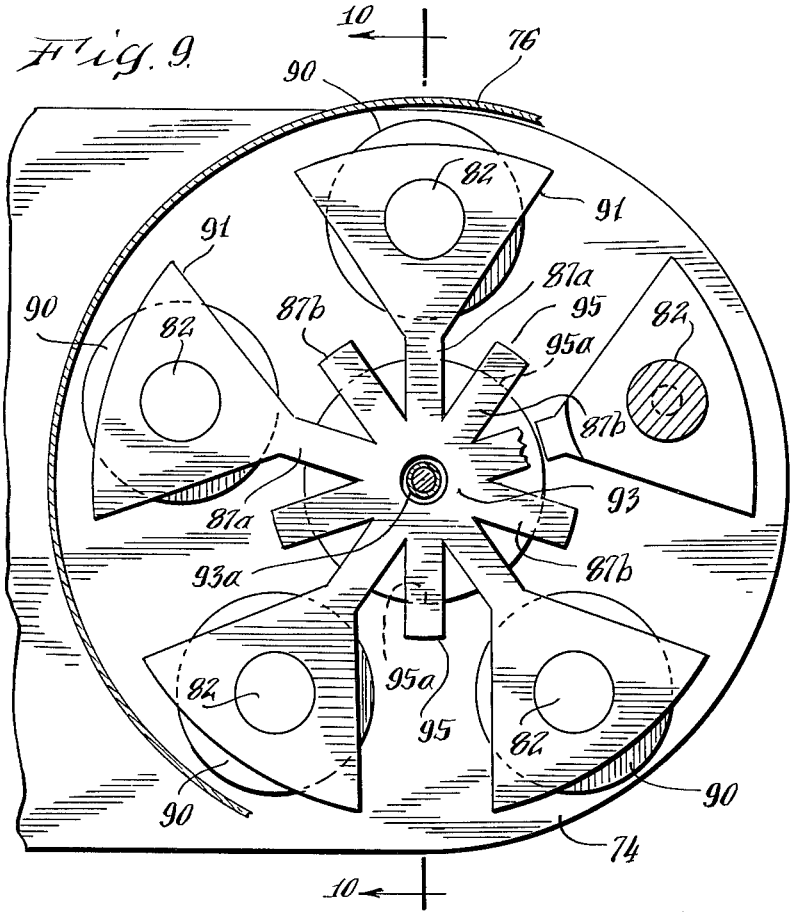
FIG. 9 is a partially broken away side elevation of an alternative mode of application of the broader principles of the invention.
Figure 10:
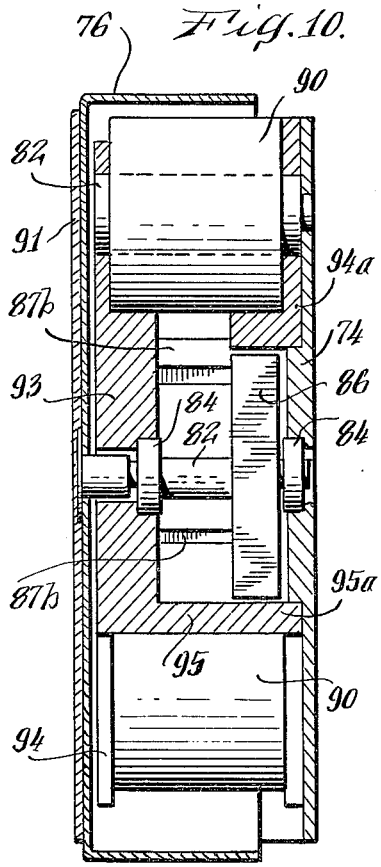
FIG. 10 is an irregular section taken on line 10—10 of FIG. 9.

The advantages of the invention as so far described in reference to a preferred embodiment can be alternatively realized in substantial measure by the differing construction shown in FIGS. 9 and 10 in which structural items that correspond without substantial change to items previously described in connection with FIGS. 1–5 bear numerals sixty units greater than the numerals applied in the mentioned figures. Referring to FIG. 9, there is shown a five-coil arrangement in which the flux-carrying return paths from the various pole pieces to oppositely disposed locations are not completely separated as in the earlier-described embodiment, but nevertheless extend axially and diametrically in a configuration which provides a significantly magnetically isolated flux path from each given pole piece to a flux concentrating region adjacent to a flux-receiving surface of the rotating magnet which is diametrically displaced from the given pole piece. This is accomplished by supporting the appropriate extremities of five coil-carrying core pieces 82 in a single ferromagnetic structure 85 (e.g. of sintered iron) having the end-on appearance indicated in FIG. 9. Specifically, this structure has ten radially extending arms or spokes, of which five (i.e. those labelled 87*a*) respectively terminate in fan-like enlargements 89 from which the various axially extending core pieces 82 and the windings 90 are supported as shown. At their inner extremities the arms 87 merge (in the manner of the spokes of a wheel) into a central unitary part or hub 98 which has a shaft-accommodating opening 93*a* coaxial with the axis of rotation of the indicator magnet 106. The spokes 87*b*, which in one sense are diametrically extended continuations of the spokes 87*a*, each terminate in an axially extending flux-carrying part 95, the inwardly directed flux-concentrating surface 95*a* of which lies in close proximity to the path of rotation of the flux-receiving surfaces of the polarized magnetic armature 86.

By the arrangement just described, although the various diametrically extending flux paths are not wholly isolated from one another as they are in FIGS. 1 through 8, they are nevertheless significantly magnetically separated, inasmuch as the linkage provided by the common hub 93 comprises only a minor part of the total flux path between, say, the pole piece 94*a* and the diametrically displaced flux dispersing surface 95*a*. Accordingly, the previously stated objectives of the invention may be effectively realized by this construction.

Figure 11:
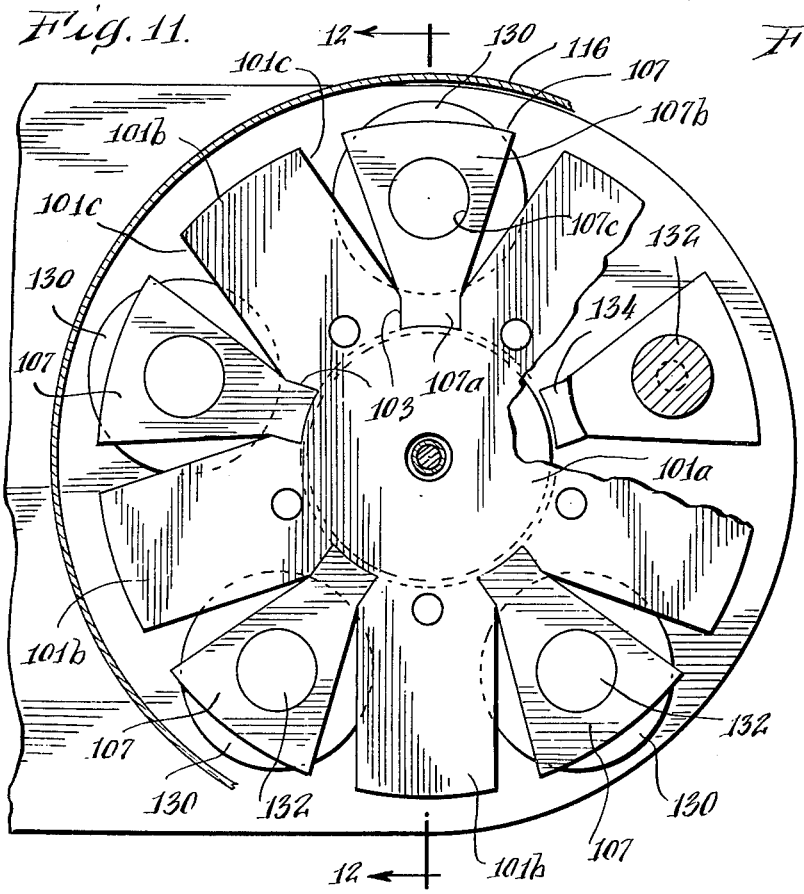
FIG. 11 is a side elevation of a still further application of the invention.
Figure 12:
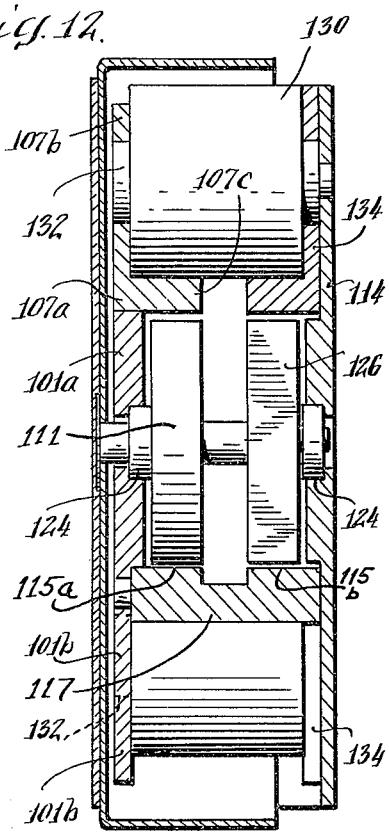
FIG. 12 is a section taken on line 12—12 of FIG. 11.

A still further embodiment of the invention is shown in FIGS. 11 and 12, in which items which correspond without substantial change to items previously described in connection with FIGS. 1 through 5 bear numerals one hundred units greater than those employed in FIGS. 1 through 5. Referring to FIG. 11, there is shown as in the foreground a non-magnetic support plate 101 (e.g. of brass). This plate has a central hub portion 101*a* from which extend five arms 101*b*, having generally parallel edges 101*c*. However, each arm is cut away near its juncture with the hub portion 101*a* to provide parallel edged slots 103. Each of these slots is sized to receive the inner part 107*a* of a ferromagnetic flux-carrying member 107, which also has an outer radially extendng fan-shaped part 107*b*.

As in the previously described constructions, each of the outer parts 107*b* has a circular opening 107*c* for receiving the axially extending core 132 of an energized coil 130. Each of the inner parts 107*a* has a short, axially directed extension 107*c* which, for purposes to be explained below, serves as a pole-piece or flux concentrator. Thus, in their joint configuration, the parts 107*a*, 107*b* and 107*c* provide a restructure which resembles generally the pole piece structure 34*a* shown in FIGS. 3 and 3A. In this case, however, each flux-concentrating part 107*c* coacts with a cylindrical ferromagnetic rotor 111 mounted on the shaft 122, and provides a substantially isolated low reluctance flux path from the winding core 132 to the rotor. This path continues through the body of the rotor and is further extended (again in isolation from other, similarly formed flux-paths) by an additional flux-carrying member.

This last mentioned member is supported by engagement with one of the arms 101*b* of support plate 101, as indicated at 117, and has flux-concentrating extremities 115*a* and 115*b*. The first of these provides a flux-receiving surface in respect to the rotor 111 and the second provides (in a relative sense) a flux-supplying surface in respect to the polarized bar magnet rotor 126.

A futher flux-concentrating relationship exists between the opposite end of the bar magnet 126 and the appropriate one of the oppositely disposed pole pieces 134. It will be seen, therefore, that while the rotor 111 may in itself have some minimal concurrent magnetic coupling with all of the coils 130, the relative isolation of the flux-carrying paths provided between any given coil and the extremities of the bar magnet rotor 126 is substantial and such as to maintain flux leakage from one path to another at a very low level. Accordingly, the principal objectives of the present invention are substantially achieved by this embodiment also.

Figure 13:
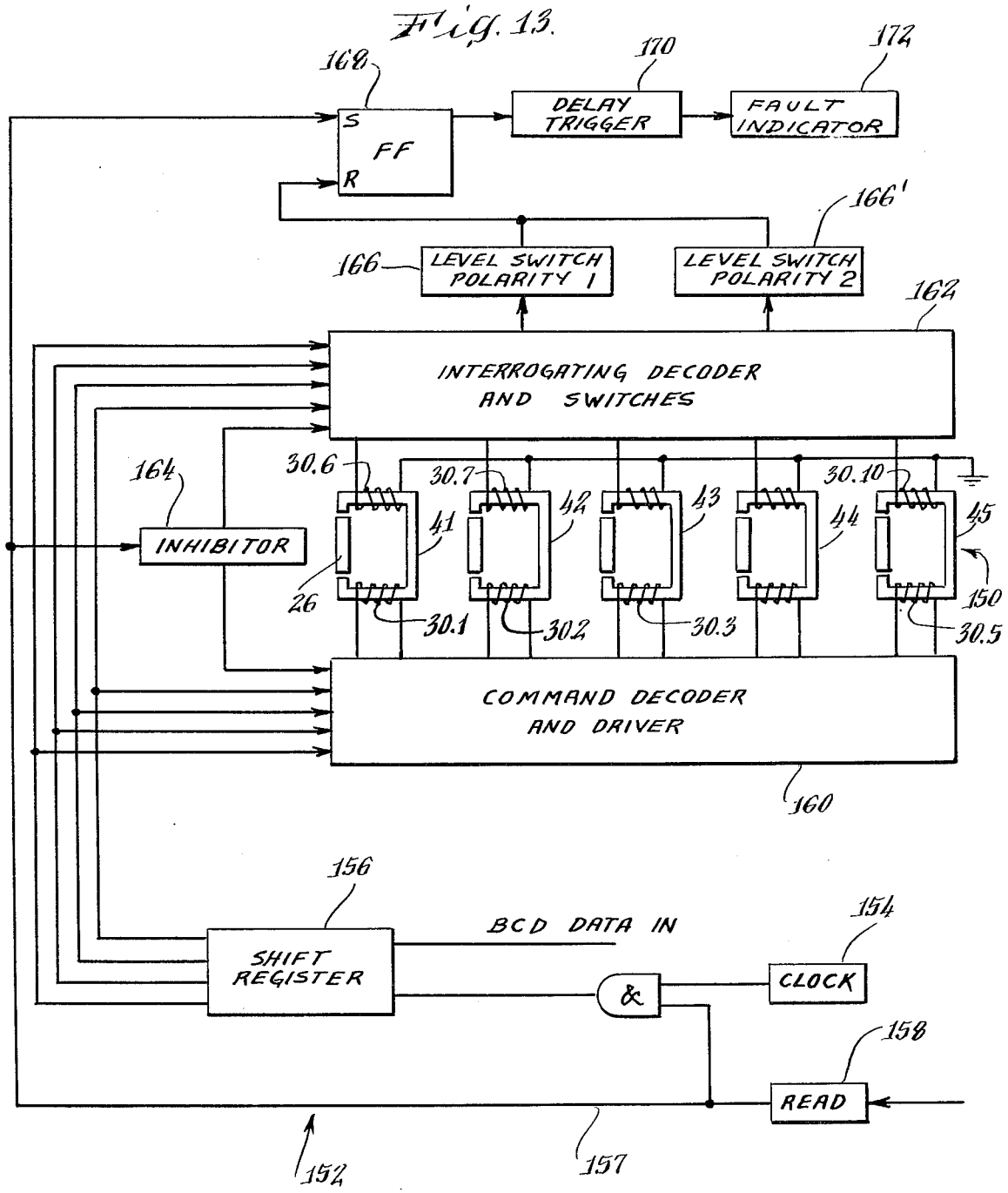
FIG. 13 is a schematic block diagram for a circuit used to check the response of an indicator assembly of this invention.

With reference to FIG. 13 an indicator 150 formed in the manner as described with reference to FIG. 3 is shown in use with a drive and sense circuit 152. The indicator 150 is illustrated in schematic form with the flux-concentrators 41–45 shown alike in shape, though as explained with reference to FIG. 3 the flux-concentrators differ from each other to enable a nesting arrangement.

The network 152 takes advantages of the indicator arrangements in accordance with the invention to enable one to sense or check whether, in fact, the rotor or armature 26 has been rotated to the proper driven position. Such sensing is achieved by interrogating a coil which is diametrally located from the coil used to drive the indicator to the desired position. Accordingly, the network 152 may be used with any one of the other indicator embodiments as described herein.

The network 152 operates to, for example, drive a coil 30.1 and monitor or interrogate the diametrally located coil 30.6 for a determination whether the rotor 26 has, in fact, arrived at the driven position.

The indicator monitoring network 152 and indicator 150 thus differ from the arrangement as described in U.S. Pat. No. 3,636,550 to Clift et al. In the latter patent, an interrogation circuit is described for an indicator whose rotor is provided with a permeable strip. The strip is sized to provide magnetic coupling of the driving flux with the coil located adjacent to the excited coil. Hence, when the rotor has arrived at the desired location, a pulse is produced from the adjacent coil.

The magnitude of the pulse is monitored to determine whether the rotor has, in fact, arrived at the proper position. If not, then a fault indicator is activated.

With the arrangement as shown in FIG. 13, a similar circuit 152 as described in FIG. 3 of the Clift patent may be used to determine whether the rotor 26 has arrived at the proper position. Thus network 152 includes a clock 154 to generate shift pulses to read in a BCD digital word from an external command signal source such as a compass or the like. The input BCD command is shifted into shift register 156 upon receipt of a signal on line 157 from a read network 158 driven by the external command signal source.

The output of the shift register 156 is applied to a command decoder and driver network 160 and an interrogating decoder and switching network 162. The read signal on line 157 is applied to an inhibitor circuit 164 which prevents the initiation of an indicator drive unit the BCD digital word has been properly inserted into shift register 156.

The command decoder and driver 160 decodes the BCD digital command with conventional logic to generate drive signals to one of the coils 30.1–30.5 with the proper polarity to drive the rotor 26 to the desired position. When a drive signal is applied to a coil 30.1 by network 160, the arrival of the rotor 26 at the proper position increases the flux linkage with diametral coil 30.6. This increase in flux generates a sense pulse on the output of coil 30.6 and is applied to interrogate network 162.

Interrogate network 162 includes appropriate decode networks responsive to the output lines from shift register 156. Hence, at the same time that the appropriate coil from the coil group 30.1–30.5 is driven by network 160, the corresponding diametral sensing coil from group 30.6–30.10 is selected to deliver an output pulse for the verification of the proper position arrival of rotor 26.

The selected sensing coil is automatically connected in the manner, for example, as shown in the Clift patent, to one of two level switch networks 166, 166′. These networks are similar in design, except that the networks respond to output pulses of different polarities.

The need to enable to respond to different polarities arises because the drive pulses applied to either of drive coils 30.1–30.5 may be of opposite polarities depending upon which number is to be inclined. Such polarity drive is common with five-coil drives for magnetic indicators.

One could use a single level switch 166 sensitive to one polarity provided that the output of the sensing coil is appropriately inverted with an inverter network. The selection of whether the pulse from a diametral sensing coil should be driven through an inverter can be made under control of the decode logic employed in network 162. Thus, for five decoded states, the sensed pulse would be automatically routed through an inverter to level switch 164 while for the other five decoded states, the pulse from sense coils 30.6–30.10 is directly applied to a level switch 166 without inversion.

The remaining circuits such as flip-flop 168, delay trigger 170 and fault indicator 172 operate as described in the Clift patent. Thus, the read pulse on line 157 causes flip-flop 168 to be set. The setting of flip-flop 168 enables the delay trigger to produce a fault pulse after, for example, several hundred milliseconds. However, if a level switch 166 generates a reset pulse before the end of the delay, the fault pulse is not produced.

When the pulse from a sensing coil 30.6–30.10 is not sufficiently high, as when the rotor is not at the correct position, then the level switch 164 fails to reset flip-flop 168 allowing the fault indicator 172 to register a fault. The ten coil magnetic indicator of this invention may thus be conveniently employed in five-coil drive circuit while the remaining diametral coils provide convenient sensors to check the proper arrival of the armature 26.

While the invention has been described by reference to specific embodiments, other and equivalent embodiments will have been made obvious to those skilled in the art. In particular, it will be understood that although the embodiments of FIGS. 6 through 12 have been described as employing five-coil arrangements, ten-coil arrangements can alternatively be employed in these embodiments in a manner analogous to the construction of FIGS. 1–5. It is, therefore, intended in the appended claims to cover all variations which come within the true spirit and scope of the invention.

What is claimed is:

1. Indicating apparatus comprising

A. a rotatable character-bearing member;

B. a rotatable magnet coupled to the character-bearing member for controlling its rotational position, said magnet having outwardly directed flux-receiving surfaces which are diametrically displaced from one another with respect to the axis of rotation of the magnet;

C. a series of electrically energizable coils arranged circumferentially in respect to the axis of rotation of the magnet;

D. a series of magnetic pole pieces respectively electromagnetically coupled with the several coils, each pole piece laying adjacent to the path of movement of the flux-receiving surfaces of the magnet;

E. means defining a significantly isolated flux path magnetically connected with and extending away from each of the said pole pieces, each such flux path i. extending first generally parallel to, then diametrally with respect to the axis of rotation of the magnet; and ii. being terminally magnetically coupled to a flux concentrator lying adjacent to the path of movement of the flux receiving surfaces of the magnet in a location diametrically displaced from the particular pole piece associated with that flux path; and F. conductive connections to the several coils for separately energizing them, thereby to rotate the magnet and the character-bearing member to desired indicating positions.

2. Indicator apparatus according to claim 1 in which the part of each of the said flux paths which extends diametrally with respect to the axis of rotation of the magnet comprises a band of ferromagnetic material having its major dimensions perpendicular to that axis.

3. Indicator apparatus according to claim 2 in which the various bands of ferromagnetic material are nested in a compact assembly with a terminal part of each band being coplanar with a corresponding part of each of the remaining bands, but with other parts of the various bands being non-coplanar so as to maintain magnetic separation between them.

4. Indicator apparatus according to claim 1 in which the flux path defining means which extends diametrally with respect to the axis of rotation of the magnet consists in part of a separate diametrally extending body of ferromagnetic material and in part of a common diametrally extending body of ferromagnetic material included in the magnetic coupling of each of said bands to its associated flux concentrator.

5. Indicator apparatus according to claim 4 in which the said common body comprises a ferromagnetic hub part to which the various separate diametrally extending bodies are connected radially in the manner of spokes of a wheel.

6. Indicator apparatus according to claim 4 in which the said common diametrally extending body comprises a ferromagnetic disk or cylinder rotatable with the said magnet.

7. Indicating apparatus comprising

A. a rotatable character-bearing member;

B. a rotatable magnet coupled to the character-bearing member for controlling its rotational position, said magnet having outwardly directed flux-receiving surfaces which are diametrically displaced from one another with respect to the axis of rotation of the magnet;

C. a series of electrically energizable coils having their axes generally parallel to and circumferentially spaced around the axis of rotation of the magnet, said coils being provided with externally accessible conductive connections for separately energizing them;

D. ferromagnetic core members extending axially through the respective coils and each terminating at one end in a flux-concentrating pole piece located adjacent to the path of rotation of the flux receiving surfaces of the magnet;

E. a plurality of separate flux-carrying structures, each of which i. is coupled to one of the said core members at the end thereof which is remote from its associated flux-concentrating pole piece;

ii. passes diametrally from one side of the axis of rotation of the magnet to the other; and iii. is terminally connected with a flux-concentrating part which extends adjacent to the path of rotation of the flux-receiving surfaces of the magnet in a location diametrically displaced from the already mentioned pole piece associated with said one of said core members.

8. Apparatus according to claim 7 in which each of the said flux-carrying structures comprises a band of ferromagnetic material having its major dimensions perpendicular to the axis of rotation to the magnet.

9. Apparatus according to claim 8 in which the various bands of ferromagnetic material are nested in a compact assembly with a terminal part of each band being coplanar with a corresponding part of each of the remaining bands, but with other parts of the various bands being non-coplanar so as to maintain magnetic separation between them.

10. Apparatus according to claim 9 in which the said bands are five in number with the first, third and fifth of said bands having their non-coplanar parts extending substantially across the axis of rotation of the bar magnet with no diametral offset and with the non-coplanar parts of the second and fourth of said bands having a central portion diametrally offset with respect to said axis.

11. Indicating apparatus comprising

A. a rotatable character-bearing member;

B. a rotatable magnet coupled to the character-bearing member for controlling its rotational position, said magnet having outwardly directed flux-receiving surfaces which are diametrically displaced from one another with respect to the axis of rotation of the magnet;

C. a series of electrically energizable coils arranged circumferentially in respect to the axis of rotation of the magnet;

D. a series of magnetic pole pieces respectively electromagnetically coupled with the several coils, each pole piece lying adjacent to the path of movement of the flux-receiving surfaces of the magnet;

E. means defining a significantly isolated flux path magnetically connected with and extending away from each of the said pole pieces, each such flux path i. extending diametrally with respect to the axis of rotation of the magnet; and ii. being terminally magnetically coupled to a flux concentrator lying adjacent to the path of movement of the flux-receiving surfaces of the magnet in a location diametrically displaced from the particular pole piece associated with that flux path;

F. conductive connections to the several coils for separately energizing them, thereby to rotate the magnet and the character-bearing member to desired indicating positions;

G. means for selecting a coil which is diametrically displaced from the particular pole piece associated with the flux path and producing a sense pulse representative of the proximity of the rotatable magnetic to the selected coil; and H. means responsive to the sense pulse for determining the arrival of the rotatable character bearing member at the desired indicating position.

12. The indicator apparatus according to claim 11 in which an even number of pole pieces are provided and uniformly distributed about the axis of rotation of the magnet to enable diametral sensing of the correct arrival of the character bearing member at the desired indicating position.

* * * * *